US007530355B2

(12) United States Patent
Berghash

(10) Patent No.: US 7,530,355 B2
(45) Date of Patent: May 12, 2009

(54) MOUTH GUARD FOR BRACES

(75) Inventor: Robert Berghash, Williamsville, NY (US)

(73) Assignee: Shield Mfg. Inc., Tonawanda, NY (US)

( * ) Notice: Subject to any disclaimer, the term of this patent is extended or adjusted under 35 U.S.C. 154(b) by 238 days.

(21) Appl. No.: 11/251,326

(22) Filed: Oct. 14, 2005

(65) Prior Publication Data

US 2007/0084472 A1 Apr. 19, 2007

(51) Int. Cl.
*A61F 11/00* (2006.01)
*A61C 5/14* (2006.01)
*A61C 3/00* (2006.01)

(52) U.S. Cl. ..... 128/861; 128/857; 128/859; 128/862; 433/6; 433/37; 602/902

(58) Field of Classification Search ..... 128/859–862, 128/845–846, 848; 433/6, 36–37, 3; 602/902
See application file for complete search history.

(56) References Cited

U.S. PATENT DOCUMENTS

| | | | | |
|---|---|---|---|---|
| 3,448,738 | A * | 6/1969 | Berghash | 128/861 |
| 4,871,310 | A * | 10/1989 | Vardimon | 433/19 |
| 5,277,203 | A * | 1/1994 | Hays | 128/861 |
| 5,406,963 | A * | 4/1995 | Adell | 128/861 |
| 5,884,628 | A * | 3/1999 | Hilsen | 128/848 |
| 5,954,500 | A | 9/1999 | Spriggs | |
| 6,508,251 | B2 | 1/2003 | Kittelsen et al. | |
| 6,637,436 | B2 | 10/2003 | Farrell | |

* cited by examiner

*Primary Examiner*—Patricia Bianco
*Assistant Examiner*—Brandon Jackson
(74) *Attorney, Agent, or Firm*—Phillips Lytle LLP; Michael J. Berchou

(57) ABSTRACT

The present invention provides an improved mouth guard (10) for braces having a U-shaped base portion (30) made from EVA or similar plastic having a melting point less than the boiling point of water, and an upper portion (20) extending generally upwardly from the outer perimeter of the base potion with an inner surface (21) made from PVC or similar material having a melting point greater than the boiling point of water, whereby a partially custom-fitted mouth guard is provided for users with braces.

10 Claims, 2 Drawing Sheets

MOUTH GUARD FOR BRACES

TECHNICAL FIELD

The present invention relates generally to the field of mouth guards, and, more particularly, to an improved, partially fitted mouth guard for use with orthodontic or dental braces.

BACKGROUND OF THE INVENTION

Mouth guards have been developed and sold for several years for use in connection with contact sports such as football and hockey, and other activities. Several prior art mouth guards comprise a U-shaped base member with inner and outer flanges that extend upwardly to surround the wearer's upper teeth. Such mouth guards cushion the impact of the upper and lower teeth and protect the teeth in response to jarring action or impact. Several prior art mouth guards are made from ethylene vinyl acetate (EVA), which is a softenable thermoplastic. EVA's softening point is less than the temperature of boiling water. Therefore, such a mouth guard may be formed, or custom fit, to the wearer's mouth by placing the mouth guard in hot water until it becomes soft, and then placing it in the wearer's mouth. Such a mouth guard retains the shape of the wearer's teeth and mouth upon cooling.

A traditional mouth guard for individuals with braces is simply placed in the wearer's mouth. Currently marketed mouth guards for braces or other dental appliances are composed of medical grade silicone, or other high temperature materials that cannot be heated or boiled for fitting around the teeth and gums. One example is disclosed in U.S. Pat. No. 5,954,500 (Spriggs). Because such traditional mouth guards cannot be fitted, they tend to move around in the mouth, making it difficult to breathe and speak, and they fail to provide adequate protection, depending at least in part upon the position at the time of impact. However, if EVA or a similar low temperature melting plastic were used, for example, the softer plastic could easily become entangled with the braces and cause damage or inconvenience such as shifting or pulling wires. Because every mouth has a different shape, a non-fitted mouth guard is inadequate for a great number of wearers. In addition, impact absorption increases with improved fit.

Multiple molding of mouth guards is not new. For example, in U.S. Pat. No. 6,508,251 (Kittelsen), multiple layers of softenable/non-softenable material are disclosed. However, the layer(s) which come in contact with the teeth (or, if a user has braces, with the braces) are made of a moldable material such as EVA, methyl methacrylete, chlorosulfonated polyethylene, fluoridated methacrylate, methacrylic acid or photo initiators. In U.S. patent application Ser. No. 10/232,240 (Publication No. 2003/0019497) (Farrell), a polyethylene "base member" is "encased" within EVA. Thus, the EVA portion, which is softenable and moldable, would come into contact with the teeth or braces. However, the prior art does not disclose a multiple-molded mouth guard with a softenable, custom fit horizontal tooth bearing surface together with a non-softenable vertical upper portion which comes in contact with braces or other dental appliances.

There is a need, therefore, for an improved mouth guard which may be fitted or formed for users having braces.

BRIEF SUMMARY OF THE INVENTION

With parenthetical reference to the corresponding pans, portions or surfaces of the disclosed embodiment, merely for purposes of illustration and not by way of limitation, The present invention provides an improved orthodontic mouth guard (10). In another aspect of the invention, the mouth guard is partially fitted or formed for users with braces. In one aspect, the improved mouth guard comprises a U-shaped base portion (30) with an outer perimeter, an inner perimeter with an inner portion or flange (31) and a bottom portion (32) which comes in contact with the bottom of a user's teeth. One aspect of the invention includes an upper portion (20) extending generally upwardly from the upper surface of the outer perimeter of the base portion. In one aspect, the base portion is made from EVA or a similar plastic having a melting point lower than boiling water, such that the base portion is formable or moldable in hot water, and the upper portion is made from a plastic or soft polymer with a higher melting point such as PVC or KRATON Isoprene rubber. Formable, as used herein, means moldable, customizable or capable of being formed in hot water (water at a temperature less than its boiling point). In another aspect of the invention, the inner surface (21) of the upper portion (20) of the mouth guard, i.e. the surface which comes into contact with a user's braces or dental appliance, cannot be formed or custom fitted at the temperatures associated with hot water which permit the forming of plastic such as EVA.

In another aspect of the invention, the upper portion (20) is molded to the U-shaped base portion (30). In other aspects, the orthodontic mouth guard of the present invention includes a retainer strap or tether (40) having a tip or end portion (42) selectively insertable into one or more openings (41A, 41B, 41C) in the retainer strap to secure the mouth guard to different sizes and shapes of helmets, face guards or other sports equipment. Other aspects of the invention provide for a method by which the base portion is molded from a formable plastic; and the upper portion is then molded to the base portion from a non-formable plastic.

The general object of the invention is to provide an improved mouth guard. Another object is to provide an improved mouth guard that is capable of fitting the teeth of a person having braces or other dental appliances. Still another object is to provide a partially fitted mouth guard that provides protection to those with braces, and is comfortable to wear. It is a further object of the invention to provide a mouth guard molded in two portions whereby the base portion coming in contact with the bottom of a wearer's teeth is softenable and formable, whereas the upper portion, and more specifically the inner surface of the upper portion which comes in contact with the outer surface of a wearer's teeth or the wearer's braces, is not softenable and formable.

These and other objects and advantages will become apparent from the foregoing and ongoing written specification, the accompanying drawings and the appended claims.

DESCRIPTION OF THE PREFERRED EMBODIMENTS

Figure 5:
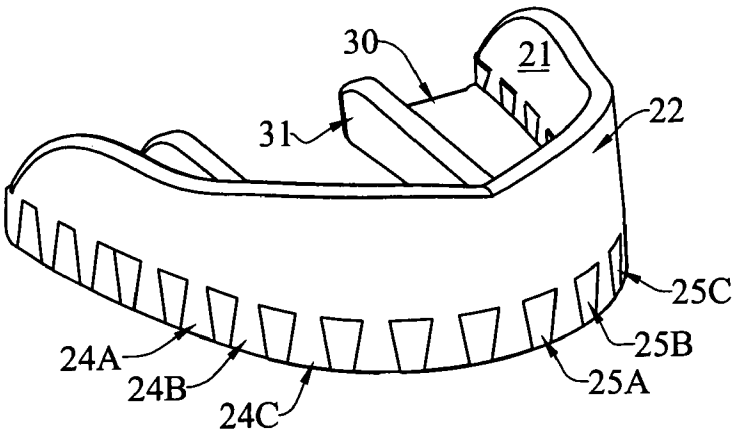
FIG. 5 is a perspective view of another embodiment of the mouth guard of the present invention.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 1:
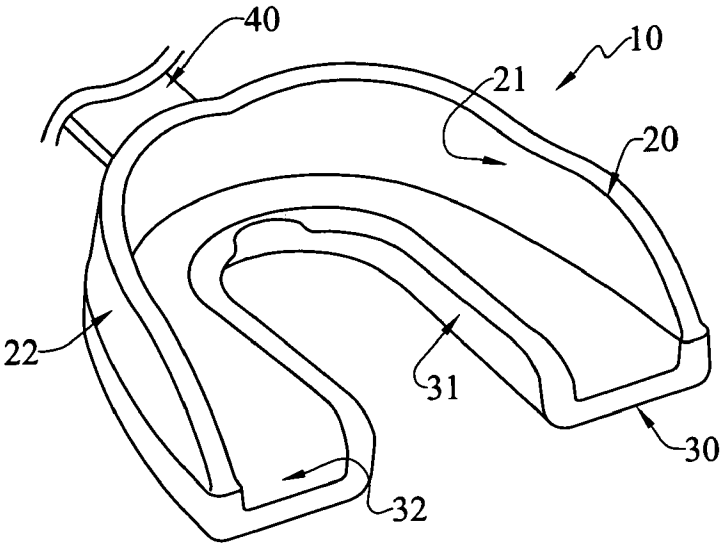
FIG. 1 is a perspective view of the orthodontic mouth guard of the present invention.

Referring now to the drawings, and, more particularly, to FIG. 1 thereof, a preferred embodiment of the present invention provides an improved mouth guard for braces 10 having a U-shaped base portion 30 and an upper portion 20 extending generally upwardly from the outer perimeter of the upper surface 32 of the base portion. The upper portion 20 of the mouth guard has an inner surface 21 which comes in contact with a user's braces and an outer surface 22 which would come in contact with the inside of the user's mouth when the mouth is closed, or be exposed when the mouth is open. The base portion in the preferred embodiment also includes an inner portion or flange 31 extending generally upwardly from the inner perimeter of the upper surface of the base portion 30. This inner portion comes in contact with part of the inside of a user's teeth and, in the preferred embodiment, is formed of the same material from which the base portion is made. In the preferred embodiment, the base portion is made from EVA or a similar low temperature melting plastic which can be boiled and fitted as in the prior art. The upper portion 20, and specifically the inside surface 21 of the upper portion which comes in contact with a user's braces, is made from a polymer such as PVC or KRATON Isoprene rubber that cannot be formed and fitted in the manner in which, and at the temperatures at which, EVA and similar plastics may be fitted. Thus, in the preferred embodiment, the mouth guard is partially fitted. The top surface of the U-shaped base portion, and the inner portion 31 of the base portion, are custom fitted to a user's teeth in the manner disclosed in the prior art, while the upper portion is not. Therefore, a user with braces may mold the mouth guard of the present invention to the bottom and part of the inside of his or her teeth without disturbing orthodontic braces. The mouth guard may include a retainer strap 40 or another connector for connection of the mouth guard to a football helmet or hockey helmet, or similar equipment, as in the prior art.

Figure 2:
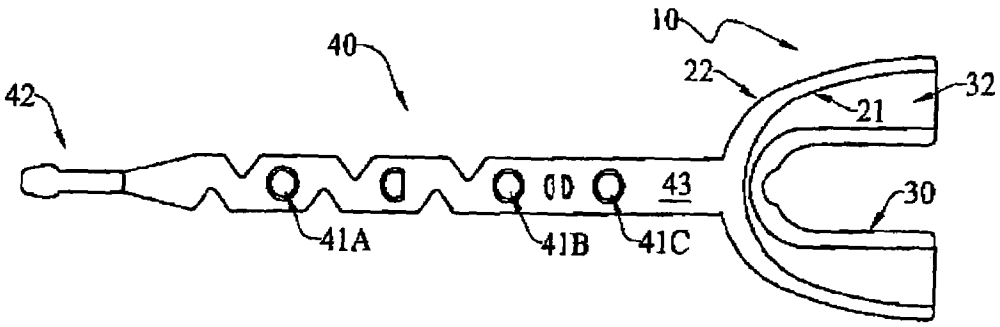
FIG. 2 is a top view of the mouth guard of the present invention.
Figure 3:
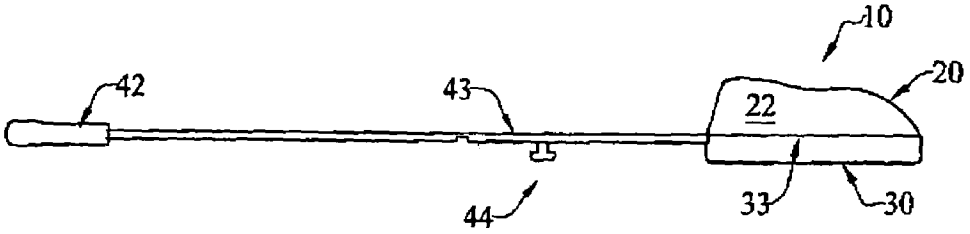
FIG. 3 is a side view of the mouth guard of the present invention.

FIG. 2 is a top view of the mouth guard 10 of the present invention having a retainer strap 40 for connection to a helmet or other sports equipment. FIG. 2 illustrates the U-shaped base portion 30 and upper portion 20 as connected to the retainer strap or tether 40. In this embodiment, the retainer strap includes an elongated, flexible main portion 43 and an end portion 42 which is selectably insertable into a series of openings or holes e.g. 41A, 41B, 41C in the strap 40. As in the prior art, insertion of the end portion into the various openings 41A, 41B, 41C provides for connection of the strap to various size sports equipment for users of different ages. FIG. 3 is a side view of the preferred embodiment which includes a retainer strap 40 having an end portion 42 (and a clasp 44 for packaging extending from the bottom of the flexible main portion 43). The figure further illustrates the outer surface 22 of the upper portion of the mouth guard and the area 33 where the upper portion 20 and the base portion 30 of the mouth guard are molded or fused together in this embodiment. In this preferred embodiment, the mouth guard is molded in two stages, as described below.

Figure 4:
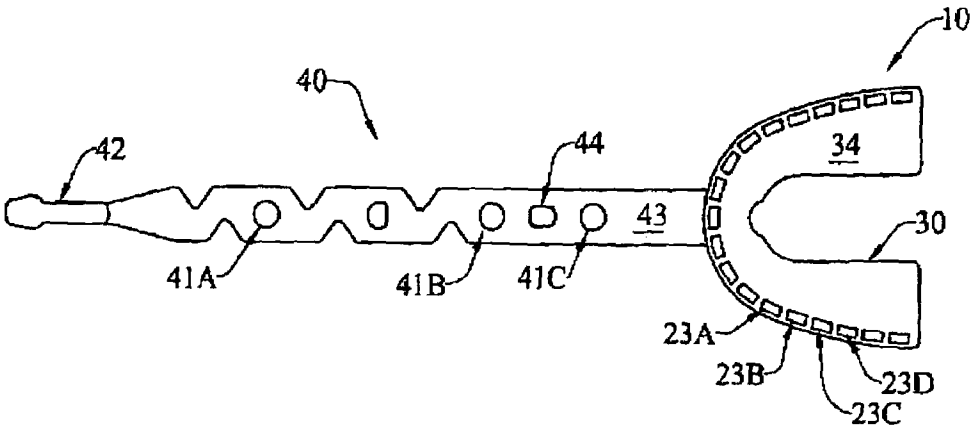
FIG. 4 is a bottom view of the mouth guard of the present invention.

FIG. 4 is a bottom view of the mouth guard of the present invention which illustrates a retainer strap 40 having an end portion 42 selectably insertable into the various openings or holes 41A, 41B, 41C of different distances from the mouth guard 10. In addition, FIG. 4 illustrates the bottom surface 34 of the base portion and the mechanical undercuts 23A, 23B, 23C, 23D in the base portion 30 whereby generally rectangular (in this illustration) male extensions from the upper portion 20 extend into corresponding female rectangular openings along the outer perimeter of the base portion 30. Molding in this embodiment is performed in two stages as follows. First, the U-shaped base portion is molded through processes known to those skilled in the art. The outer perimeter of the base portion, as molded, includes a plurality of openings or voids 23A, 23B, 23C, 23D which may be in the shape of a rectangle or triangle, or another appropriate shape, which voids or openings extend from the bottom surface 34 of the base portion through the upper surface 32 of the base portion. After molding this base portion, it is placed into a second mold to be molded or fused together with an upper portion 20 (made of PVC or similar material which cannot be formed in hot water) through known molding processes. Thus, when the two portions are molded together, the voids or openings in the base portion are filled with the PVC (or similar material) which creates the mechanical undercuts, insuring that the two portions cannot be pulled apart.

FIG. 5 illustrates another embodiment of the present invention wherein the base portion 30 includes trapezoidal protrusions 25A, 25B, 25C extending generally upwardly from the outer perimeter of the horizontally-oriented U-shaped base portion, and corresponding interlocking protrusions 24A, 24B, 24C formed in the second stage of molding (similar to the mechanical undercuts in the example above). When the base portion (with trapezoidal protrusions or members) is placed in a second mold, the PVC fills the trapezoidal (or another shape) voids created by the trapezoidal protrusions or members of the base portion, creating corresponding interlocking members molded together and insuring that the two portions cannot be separated.

In a preferred embodiment, the base portion 30 of the mouth guard is made from EVA or a similar plastic having a low melting point (i.e. softenable in hot water). This allows part of the mouth guard to mold to the general shape of the teeth. The surface of the upper portion of the mouth guard that touches or comes in contact with the braces 21 is made from a soft polymer such as PVC or KRATON Isoprene Rubber that cannot be formed or softened at the low temperatures at which EVA may be formed. This permits a custom fit without disturbing the user's braces. In addition, the molding of the guard on the lower portion of the teeth increases comfort and impact absorption, reducing tooth injuries and concussions. In one preferred embodiment, the upper portion 20 is sloped inward toward the user's teeth and gums to conform to the natural slope of the teeth and gums.

While there has been described what is believed to be the preferred embodiment of the present invention, those skilled in the art will recognize that other and further changes and modifications may be made thereto without departing from the spirit of the invention. Therefore, the invention is not limited to the specific details and representative embodiments shown and described herein. Accordingly, persons skilled in this art will readily appreciate that various additional changes and modifications may be made without departing from the spirit or scope of the invention, as defined and differentiated by the following claims. In addition, the terminology and phraseology used herein is for purposes of description and should not be regarded as limiting.

What is claimed is:

1. A mouth guard for braces, comprising:

a unitary, formable U-shaped base portion having an outer perimeter and an inner perimeter, and having a formable flange extending generally upwardly from said inner perimeter;

an upper portion extending generally upwardly along said outer perimeter of said base portion, said upper portion having a non-formable exposed inner surface; and said upper portion being molded to said base portion.

2. The mouth guard for braces set forth in claim 1, wherein said base portion is made of EVA or plastic having a melting point less than the temperature of boiling water.

3. The mouth guard for braces set forth in claim 1, wherein said upper portion is made of PVC, Isoprene rubber or plastic having a melting point greater than the temperature of boiling water.

4. The mouth guard for braces set forth in claim 1, wherein said inner surface of said upper portion is made of PVC, Isoprene rubber or plastic having a melting point greater than the temperature of boiling water.

5. The mouth guard for braces set forth in claim 1, wherein said outer perimeter of said base portion defines a plurality of female voids, and said upper portion comprises a plurality of male extension portions corresponding to said female voids, wherein said male extension portions extend into corresponding female voids.

6. The mouth guard for braces set forth in claim 1, further comprising:

a retainer strap molded to said mouth guard.

7. The mouth guard for braces set forth in claim 1, wherein said base portion comprises a plurality of first interlocking members, and said upper portion comprises a plurality of corresponding second interlocking members, wherein said first interlocking members are molded to said second interlocking members.

8. The mouth guard for braces set forth in claim 7 wherein each of said interlocking members are trapezoidal in shape.

9. A mouth guard for braces, comprising:

a unitary, formable U-shaped base portion of uniform composition having an outer perimeter and an inner perimeter, and having a formable bottom surface;

an upper portion extending generally upwardly along said outer perimeter of said base portion, said upper portion having a non-formable exposed inner surface; and said upper portion being molded to said base portion.

10. The mouth guard for braces set forth in claim 9, wherein said base portion comprises a plurality of first interlocking members, and said upper portion comprises a plurality of corresponding second interlocking members, wherein said first interlocking members are molded to said second interlocking members.

* * * * *